US009475280B2

(12) United States Patent
Zhang

(10) Patent No.: US 9,475,280 B2
(45) Date of Patent: Oct. 25, 2016

(54) LIQUID EJECTING APPARATUS, CONTROL METHOD OF LIQUID EJECTING HEAD, AND CONTROL METHOD OF LIQUID EJECTING APPARATUS

(71) Applicant: Seiko Epson Corporation, Shinjuku-ku (JP)

(72) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/720,657

(22) Filed: May 22, 2015

(65) Prior Publication Data

US 2015/0343763 A1 Dec. 3, 2015

(30) Foreign Application Priority Data

May 28, 2014 (JP) ..... 2014-109721

(51) Int. Cl.
*B41J 2/165* (2006.01)
*B41J 2/045* (2006.01)

(52) U.S. Cl.
CPC ..... *B41J 2/0451* (2013.01); *B41J 2/04581* (2013.01); *B41J 2/04588* (2013.01); *B41J 2/16526* (2013.01); *B41J 2/16579* (2013.01)

(58) Field of Classification Search
CPC ..... B41J 2/16535
USPC ..... 347/23, 35, 36, 10, 33
See application file for complete search history.

(56) References Cited

U.S. PATENT DOCUMENTS

2006/0187257 A1* 8/2006 Ito ..... 347/35
2009/0079788 A1 3/2009 Hosono et al.

FOREIGN PATENT DOCUMENTS

JP 2009-073076 A 4/2009

* cited by examiner

*Primary Examiner* — Lam Nguyen
(74) *Attorney, Agent, or Firm* — Kilpatrick Townsend & Stockton LLP

(57) ABSTRACT

When a nozzle abnormality detecting mechanism detects an abnormality of the nozzle, in the maintenance process of causing the drive waveform to be applied plural times to the actuator corresponding to the nozzle that the detecting mechanism detects as being abnormal, and thereby causing the ejecting operation to be performed, at least a first-time drive waveform applied to the actuator is a flushing pulse which causes a meniscus in the nozzle not to be positively attracted from an initial position to the pressure chamber, but causes the meniscus to be extruded to the ejection side and thereby causes the liquid to be ejected from the nozzle.

5 Claims, 8 Drawing Sheets

LIQUID EJECTING APPARATUS, CONTROL METHOD OF LIQUID EJECTING HEAD, AND CONTROL METHOD OF LIQUID EJECTING APPARATUS

CROSS REFERENCE TO RELATED APPLICATIONS

This application claims priority to Japanese Patent Application No. 2014-109721 filed on May 28, 2014. The entire disclosure of Japanese Patent Application No. 2014-109721 is hereby incorporated herein by reference.

BACKGROUND

1. Technical Field

The present invention relates to a liquid ejecting apparatus such as an ink jet type recording apparatus, a control method of a liquid ejecting head mounted in the liquid ejecting apparatus, and a control method of the liquid ejecting apparatus. Particularly, the invention relates to a liquid ejecting apparatus a control method of the liquid ejecting head and a control method of the liquid ejecting apparatus that perform a maintenance process in which a liquid is ejected from nozzles and ejection performance of the liquid ejecting head is restored.

2. Related Art

A liquid ejecting apparatus includes a liquid ejecting head to eject (discharge) various types of liquid from the liquid ejecting head. The liquid ejecting apparatus includes, for example, an ink jet type printer, an ink jet type plotter and the like. Recently, however, in order to use an advantage that an extreme small amount of liquid can be exactly landed on a predetermined position, the liquid ejecting apparatus is also applied to various types of manufacturing apparatuses. For example, the liquid ejecting apparatus is applied to a display manufacturing apparatus for manufacturing a color filter such as a liquid crystal display, an electrode forming apparatus for forming electrodes such as organic electro luminescence (EL) display, FED (a surface light emitting display) and the like, and a chip manufacturing apparatus for manufacturing a biochip (biochemical element). Further, a recording head for an image recording apparatus ejects a liquid ink, whereas a coloring material ejecting head for a display manufacturing apparatus ejects solution of each coloring material such as red (R), green (G), or blue (B). Further, an electrode material ejecting head for an electrode forming apparatus ejects a liquid electrode material, and a bio-organic material ejecting head for a chip manufacturing apparatus ejects a solution of the bio-organic material.

In a liquid ejecting head, air bubbles are likely to be mixed into the liquid in the nozzle. Specifically, for example, when a wiping member (such as a wiper formed of an elastic member) slides on a surface on which nozzles of the liquid ejecting head are formed to wipe and clean the nozzle surface, the air bubbles are likely to penetrate into the liquid in the nozzle. Further, a very fine paper powder is likely to be generated from the recording paper as a recording media, and likely to be attached to the nozzle surface and enter into the nozzle, and thereby the air bubbles enter into the liquid in the nozzle through the entered paper powder. Furthermore, when the liquid thickened in the vicinity of the nozzle is ejected, the air bubbles are also likely to enter into the liquid.

In the liquid ejecting apparatus with such a type of liquid ejecting head mounted thereon, in order to discharge the air bubbles or the thickened liquid in the nozzle or in the pressure chamber of the liquid ejecting head, a maintenance process so called flushing is performed in which the liquid is forced to be ejected from the nozzle (see, for example, JP-A-2009-073076), independently of the liquid ejecting process for an landing target such as the recording media, that is, the ejecting process for original purpose. In the flushing process, a drive waveform is applied to an actuator to drive the actuator to cause a pressure variation of the liquid in the pressure chamber communicating with the nozzle, and thereby the pressure variation is used to eject (also referred to as releasing strike or idle discharge) the liquid from the nozzle. In this case, generally, after the pressure chamber is firstly decompressed to attract a meniscus in the nozzle to the pressure chamber, the pressure is drastically compressed to extrude the meniscus to a side (an ejection side) opposite to the pressure chamber and thereby the liquid droplet is ejected from the nozzle. Such an operation is continuously repeated a predetermined number of times to discharge the thickened liquid in the nozzle or the pressure chamber.

However, in the flushing process of the related art, it is difficult to discharge the air bubbles inside the liquid in the nozzle. Specifically, during the first-time decompression in the pressure chamber in the flushing process of the related art, the air bubbles moves to the pressure chamber and thus air bubbles are hardly discharged even though the flushing process is repeatedly performed.

SUMMARY

An advantage of some aspects of the invention is to provide a liquid ejecting apparatus, a control method of the liquid ejecting head, and a control method of the liquid ejecting apparatus in which it is possible to reduce the unnecessary consumption of the liquid and to efficiently discharge the air bubbles inside the liquid in the nozzle.

In order to realize the above advantage, according to one aspect of the invention, there is provided a liquid ejecting apparatus including a liquid ejecting head that includes pressure chambers communicating with nozzles, and actuators causing a pressure variation of liquid in the pressure chamber to occur, the liquid ejecting head being able to eject the liquid from the nozzle through an action of the actuator; and a detecting mechanism that detects an abnormality of the nozzle in liquid ejection. The liquid ejecting apparatus drives the actuator with a drive waveform to perform a maintenance process. In the maintenance process of causing the drive waveform to be applied plural times to the actuator corresponding to the nozzle that the detecting mechanism detects as being abnormal, and thereby causing the ejecting operation to be performed, at least a first-time drive waveform applied to the actuator is a maintenance drive waveform which causes a meniscus in the nozzle not to be positively attracted from an initial position to the pressure chamber, but causes the meniscus to be extruded to the ejection side and thereby causes the liquid to be ejected from the nozzle.

According to one aspect of the invention, it is possible to suppress the unnecessary consumption of the liquid and to discharge the air bubbles inside the liquid in the nozzle. Specifically, the maintenance process is performed on the nozzle that is detected as being abnormal to restrain the unnecessary maintenance process from being performed. Further, since the air bubbles inside the liquid in the nozzle hardly float to the pressure chamber in the ejecting operation based on the maintenance drive waveform which is applied in at least a first time, it is possible to efficiently discharge the air bubbles with the liquid in the nozzle. Therefore, the consumption of the liquid can be largely suppressed, compared with the maintenance process of the related art.

Further, the ejecting operation means the operation of the actuator which causes a pressure variation to the extent that the actuator is driven with a drive waveform to eject the liquid from the nozzle in the pressure chamber, regardless of whether or not the liquid is actually ejected from the nozzle as a result of the ejecting operation.

In the configuration described above, it is preferable that in the maintenance process, among the drive waveforms which are applied to the actuator three or more times, at least the first-time to the third-time drive waveforms are the maintenance drive waveforms.

According to the configuration described above, the maintenance drive waveform is applied three times to perform the ejecting operation, and thus the air bubbles in the nozzle can be further certainly discharged.

In the configuration described above, it is preferable that the maintenance drive waveform is a drive waveform that causes the largest liquid amount which the liquid ejecting head can eject to be ejected.

According to the configuration described above, since a relatively greater amount of the liquid for one time can be ejected from the nozzle and the pressure variation in the pressure chamber goes along slowly during the ejecting operation, compared with the drive waveform which causes the small liquid droplet to be ejected, the unnecessary vibration is hardly generated in the pressure chamber and it is possible to more efficiently discharge the air bubbles from the nozzle.

According to another aspect of the invention, there is provided a control method of a liquid ejecting head that includes pressure chambers communicating with nozzles, and actuators causing a pressure variation of liquid in the pressure chamber to occur. The liquid ejecting head drives the actuator with a drive waveform to able to eject the liquid from the nozzle. The control method includes: in a maintenance process of causing the drive waveform to be applied plural times to the actuator corresponding to the nozzle that is detected as being abnormal in liquid ejection, and thereby causing the ejecting operation to be performed, applying a maintenance drive waveform to the actuator in at least a first time, the maintenance drive waveform causing a meniscus in the nozzle not to be positively attracted from an initial position to the pressure chamber, but causing the meniscus to be extruded to the ejection side, and thereby causing the liquid to be ejected from the nozzle.

According to still another aspect of the invention, there is provided a control method of a liquid ejecting apparatus including a liquid ejecting head that includes pressure chambers communicating with nozzles, and actuators causing a pressure variation of liquid in the pressure chamber to occur, the liquid ejecting head being able to eject the liquid from the nozzle through an action of the actuator; and a detecting mechanism that detects an abnormality of the nozzle in liquid ejection. The liquid ejecting apparatus drives the actuator with a drive waveform to perform a maintenance process. The control method includes in the maintenance process of causing the drive waveform to be applied plural times to the actuator corresponding to the nozzle that is detected as being abnormal in liquid ejection, and thereby causing the ejecting operation to be performed, applying a maintenance drive waveform to the actuator in at least a first time, the maintenance drive waveform causing a meniscus in the nozzle not to be positively attracted from an initial position to the pressure chamber, but causing the meniscus to be extruded to the ejection side, and thereby causing the liquid to be ejected from the nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. The embodiments described below are limited to concretely preferable examples of the invention in various manners. However, the scope of the invention is not limited to these embodiments unless otherwise stated particularly for limiting the invention. Further, hereinafter, an ink jet type recording apparatus (hereinafter referred to as a printer) will be described as an example of the liquid ejecting apparatus according to one aspect of the invention.

Figure 1:
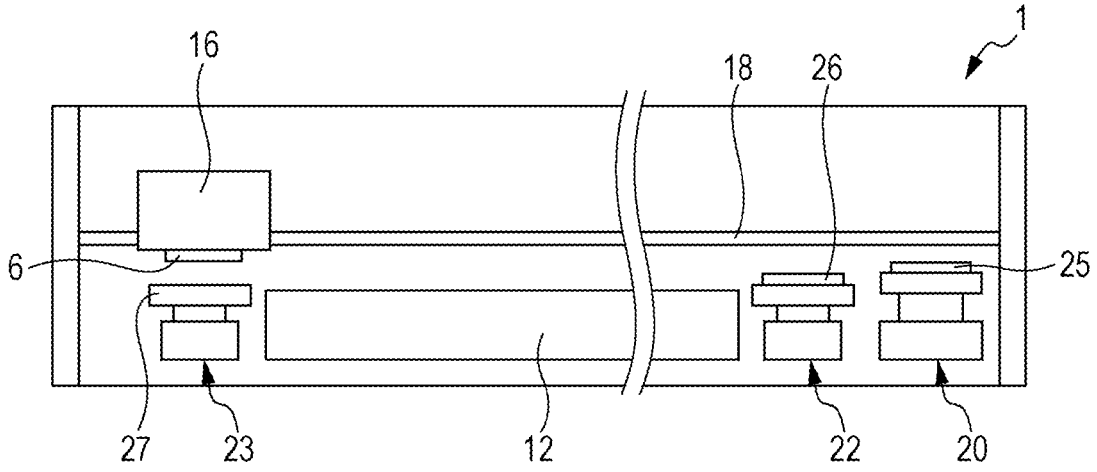
FIG. 1 is a front view explaining an internal configuration of a printer.
Figure 2:
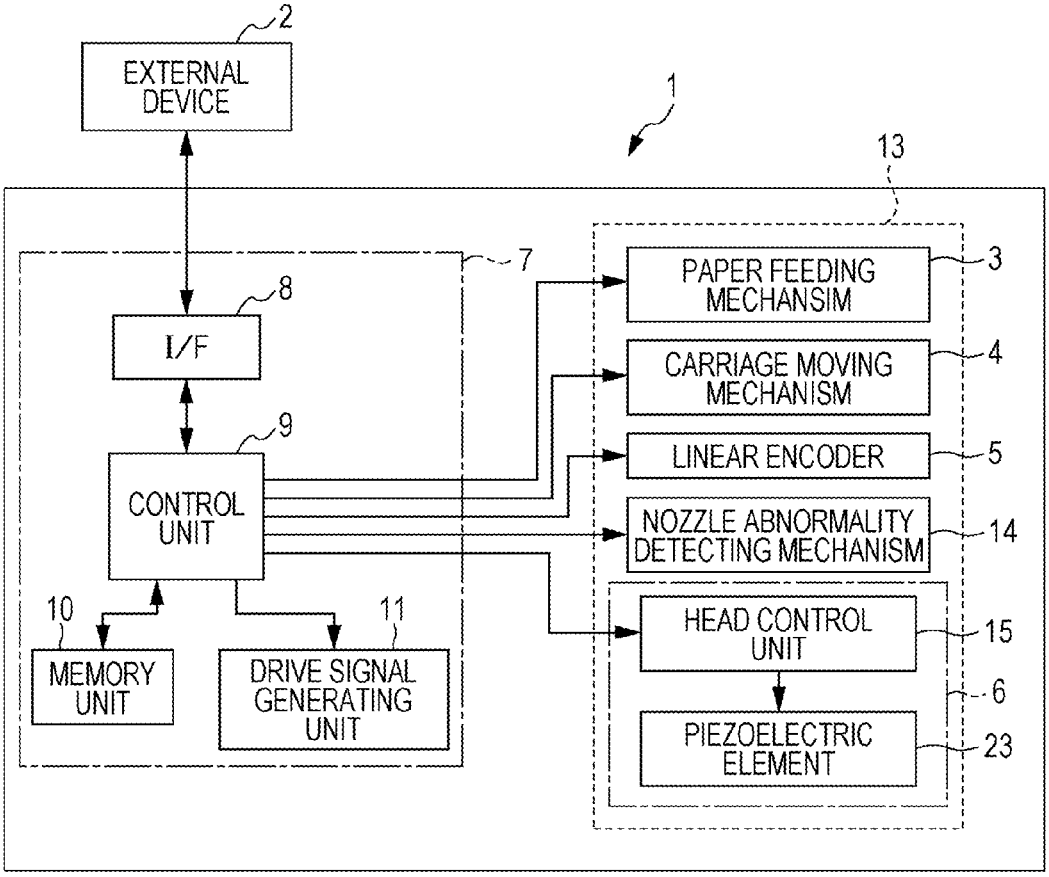
FIG. 2 is a block diagram for explaining an electrical configuration of the printer.

FIG. 1 is a front view explaining an internal configuration of a printer 1, and FIG. 2 is a block diagram for explaining an electrical configuration of the printer 1. The printer 1 according to the embodiment is electrically connected to, for example, an external device 2 such as electric equipment of an computer and the like in wireless or wired manner, and receives printing data for reflecting an image or a text and the like from the external device 2 so as to print the image or the text on recording media (a landing target of liquid) such as recording papers. The printer 1 includes a printer controller 7 and a print engine 13. A recording head 6 is a type of the liquid ejecting head, and is attached to a bottom side of a carriage 16. The carriage 16 has an ink cartridge 17 (a liquid supplying source) mounted thereon. Further, the carriage 16 is configured to be reciprocally moved by a carriage moving mechanism 4 along a guide rod 18. In other words, the printer 1 sequentially transports the recording media on a platen 12 using a paper feeding mechanism 3. The printer 1 also causes the recording head 6 to be relatively moved in the width direction (a main scanning direction) of the recording media, and ejects the ink as a kind of the liquid according to an aspect of the invention from a nozzle 37 (see FIG. 3 and FIG. 9A to FIG. 9C) of the recording head 6 to land the ink and thus record the image and the like on the recording media. Further, a configuration may be applied in which the ink cartridge 17 is disposed in the printer main body and the ink of the ink cartridge 17 is sent to the recording head 6 through a supplying tube.

As the ink described above, various types of inks such as dye ink and pigment ink may be used. In the embodiment, an ink of which viscosity η1 is approximately 4.12 [mPa·s] in the room temperature (for example, 25° C.) may be used. Further, an ink of which viscosity η2 is approximately 5.0 [mPa·s] in the room temperature may be also used. In any case, it is preferable that the density of the ink is in a range between greater than or equal to 1050 [g/cm3] and less than or equal to 1100 [g/cm3], and it is suitable that the viscosity is in a range between greater than or equal to 3 [mPa·s] and less than or equal to 6 [mPa·s].

A home position which is a standby place of the recording head 6 is provided in a position outside of the platen 12 (the right part of FIG. 1) in one end portion of the main scanning direction. A capping mechanism 20 and a wiping mechanism 22 are provided in the home position in an order from the one end thereof. Further, a flushing box 23 as a flushing area is provided in the other end portion of the main scanning direction (the left part of FIG. 1), and the platen 12 is interposed between the home position and the other end. The capping mechanism 20 includes a cap 25 formed of, for example, elastic material such as an elastomer, and is configured to be converted from a sealing state to a standby state and vice versa. The sealing state (capping state) means that the cap 25 is contacted with the nozzle surface (nozzle plate 31) of the recording head 6 to seal the nozzle surface, and the standby state means that the cap 25 is separated from the nozzle surface. Furthermore, the capping state of the nozzle surface causes the space within the cap to be under a negative pressure (to be attracted), and thereby it is possible to perform a cleaning processing which causes the ink to be discharged into the cap from the nozzle.

The wiping mechanism 22 includes a wiper 26 which can be moved along in the direction (a nozzle column direction or a sub-scanning direction) intersecting with the main scanning direction. Further, the wiping mechanism is configured to convert the wiper 26 from a contact state to a standby state and vice versa. The contact state means that the wiper 26 is contacted with the nozzle surface of the recording head 6, and the standby state means that the wiper 26 is separated from the nozzle surface. The wiper 26 may have various types of configurations, but for example, the surface of the elastic blade body is covered with a cloth according to the embodiment. In a state where wiper 26 is contacted with the nozzle surface, the wiping mechanism 22 moves the wiper 26 in a sliding manner from one direction to the other direction in the nozzle column to wipe the nozzle surface. The flushing box 23 includes an ink receiving unit 27 of a tray-like that receives the ink which is ejected when a flushing process is performed. In the flushing process, the ink is forced to be ejected from the nozzle of the recording head 6 regardless of a recording process on the recording media. The location of the ink receiving unit 27 is fixed.

The printer controller 7 is a controller unit that controls each part of the printer. The printer controller 7 according to the embodiment includes an interface (I/F) unit 8, a control unit 9, a memory unit 10 and a drive signal generating unit 11. The interface unit 8 transmits a printing data or a printing instruction from the external device 2 to the printer 1. When state information of the printer 1 is output to the external device 2, the interface unit 8 transmits and receives the state data of the printer. The control unit 9 is a computing device that controls an entire portion of the printer. The memory unit 10 is a memory element that stores a program of the control unit 9, or data for various types of controls, and may include ROM, RAM, and NVRAM (non-volatile memory element). The control unit 9 controls each unit according to the program stored in the memory unit 10. Further, based on the printing data from the external device 2, the control unit 9 according to the embodiment generates ejecting data indicating the selections of nozzle 37 and timing for ejecting the ink during the recording process, and transmits the ejecting data to the head control unit 15 of the recording head 6. Further, the control unit 9 according to the embodiment functions as a control section that performs the flushing process which is a kind of the maintenance process. This point will be described in detail later.

The drive signal generating unit 11 (drive waveform generating section) generates a drive signal which includes a drive pulse which causes the ink to be ejected on the recording media and causes images and the like to be recorded thereon. Further, the drive signal generating unit 11 according to the embodiment is configured to be capable of generating a maintenance drive signal (a flushing drive signal COM) which includes a maintenance drive waveform (a flushing pulse Pf). The detail of the flushing drive signal will be described later.

Hereinafter, the print engine 13 will be described. As shown in FIG. 2, the print engine 13 includes a paper feeding mechanism 3, a carriage moving mechanism 4, a linear encoder 5, a nozzle abnormality detecting mechanism 14, a recording head 6 and the like. The carriage moving mechanism 4 includes a carriage 16 with a recording head 6 attached thereto, a driving motor (for example, DC motor) that causes the carriage 16 to run through a timing bell and the like (not shown). The carriage moving mechanism 4 also moves the recording head 6 which is mounted on the carriage 16, in the main scanning direction. The paper feeding mechanism 3 is configured to include a paper feeding motor, a paper feeding roller, and the like (which are all not shown), and sequentially transports the recording media on the platen 12 to perform a sub-scanning. Further, the linear encoder 5 outputs encoder pulses as positional information in the main scanning direction to the printer controller 7, and the encoder pulse is generated according to the scanning position of the recording head 6 which is mounted on the carriage 16. The printer controller 7 can figure out a scanning position (a current position) of the recording head 6 based on the encoder pulse which is received from the linear encoder 5. The nozzle abnormality detecting mechanism 14 is a mechanism that tests whether or not the ink is normally ejected from the nozzle 37 of the recording head 6. The detail of the process of detecting the nozzle using the nozzle abnormality detecting mechanism 14 will be described later.

Figure 3:
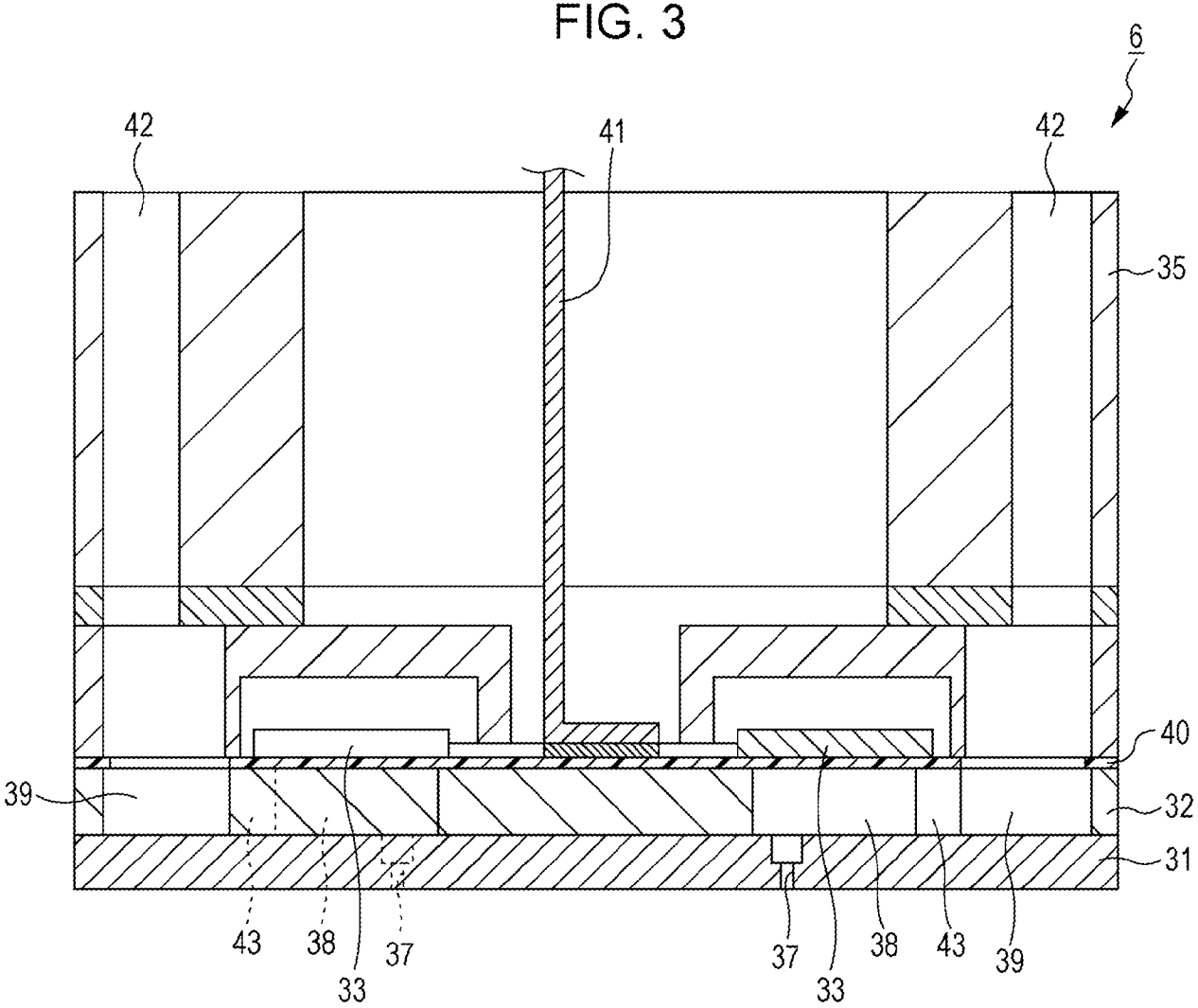
FIG. 3 is a sectional view explaining an internal configuration of a recording head.

FIG. 3 is a sectional view explaining the main portion of the internal configuration of the recording head 6. The recording head 6 according to the embodiment is schematically configured to include a nozzle plate 31, a flow path substrate 32, a piezoelectric element 33, and the like, which members are overlapped one after another to be mounted on a case 35. The nozzle plate 31 is a member formed of silicon single crystal substrate in which a plurality of nozzles 37 is arranged in a column-like along the same direction in pitches corresponding to the dot forming density. In the embodiment, the nozzle columns (a kind of nozzle group) formed of a plurality of nozzles 37 in parallel is disposed in the form of two columns in parallel on the nozzle plate 31.

Further, the nozzle surface corresponds to a surface in a side to which the ink in the nozzle plate 31 is discharged.

The nozzle 37 has a cylindrical shape in which plural steps of different inner diameters are formed using a dry etching. The nozzle 37 according to the embodiment has a two-step structure formed of the first nozzle unit 37*a* disposed in a pressure chamber 38 side (to be described later) and the second nozzle unit 37*b* disposed on an ejection side (see FIG. 9A to FIG. 9C). Further, the inner diameter of the first nozzle unit 37*a* is set to be larger than that of the second nozzle unit 37*b*. Specifically, the inner diameter of the second nozzle unit 37*b* is set to 20 [μm], whereas the inner diameter of the first nozzle unit 37*a* is set to 45 [μm]. Further, the length of the second nozzle unit 37*b* in the axial direction is set to 30 [μm], and the length of the first nozzle unit 37*a* in the axial direction is set to 40 [μm]. Further, the nozzle plate 31 may be formed of, for example, a metal plate such as stainless steel, not limited to the silicon single crystal substrate. Further, the nozzle 37 may have any type of structure as long as the nozzle 37 has a structure in which a strait unit having a cylindrical shape of a constant inner diameter is provided at least in the ejection side. Further, the nozzle 37 may have a structure in which the entire inner diameter of the nozzle is constant (cylindrical nozzle) or a tapering structure in which an inner diameter of a part corresponding to the first nozzle unit 37*a* increases from the ejection side to the pressure chamber side.

The flow path substrate 32 includes a plurality of pressure chambers 38 which are partitioned with a plurality of partition walls and which are respectively formed to correspond to the nozzle 37. A common liquid chamber 39 partitioning a part of the pressure chamber 38 is formed outside of the column of the pressure chamber 38 in the flow path substrate 32. The common liquid chamber 39 communicates individually with each pressure chamber 38 through ink supplying ports 43. Further, the ink is introduced from the ink cartridge 17 to the common liquid chamber 39 through ink introducing path 42 of the case 35. A piezoelectric element 33 (a kind of actuator) is formed on the top surface of a side opposite to the nozzle plate 31 of the flow path substrate 32 with an elastic film 40 interposed between the piezoelectric element 33 and the top surface. The piezoelectric element 33 is formed to include a structure in which a metallic lower electrode film, for example, a piezoelectric body layer formed of lead zirconate titanate and the like, and a metallic higher electrode film (which are all not shown) are sequentially overlapped one after another. The piezoelectric element 33 is so called a bending mode, and is formed to cover the top portion of the pressure chamber 38. In the embodiment, two columns of the piezoelectric elements corresponding to the two columns of the nozzle are orthogonal to the nozzle column to be disposed in parallel to and to be in different locations from each other when seen in the direction of the nozzle column. Each piezoelectric element 33 is deformed when a drive signal is applied thereto through a wiring member 41. This deformation causes the pressure variation to occur in the ink in the pressure chamber 38 corresponding to the piezoelectric element 33, and the pressure variation of the ink is controlled to eject the ink from the nozzle 37.

The printer 1 according to one aspect of the invention is characterized in that it has a purpose to perform a flushing process in which, during a recording process which, for example, the recording head 6, performs on the recording media at a regular time interval, or after the wiping mechanism 22 wipes the nozzle surface (the nozzle plate 31) of the recording head 6, the printer 1 performs testing (the nozzle testing process) of whether or not the ink is normally ejected from the nozzle 37, and removes air bubbles in the nozzle 37 according to the detection result. Hereinafter, this point will be described.

Figure 4:
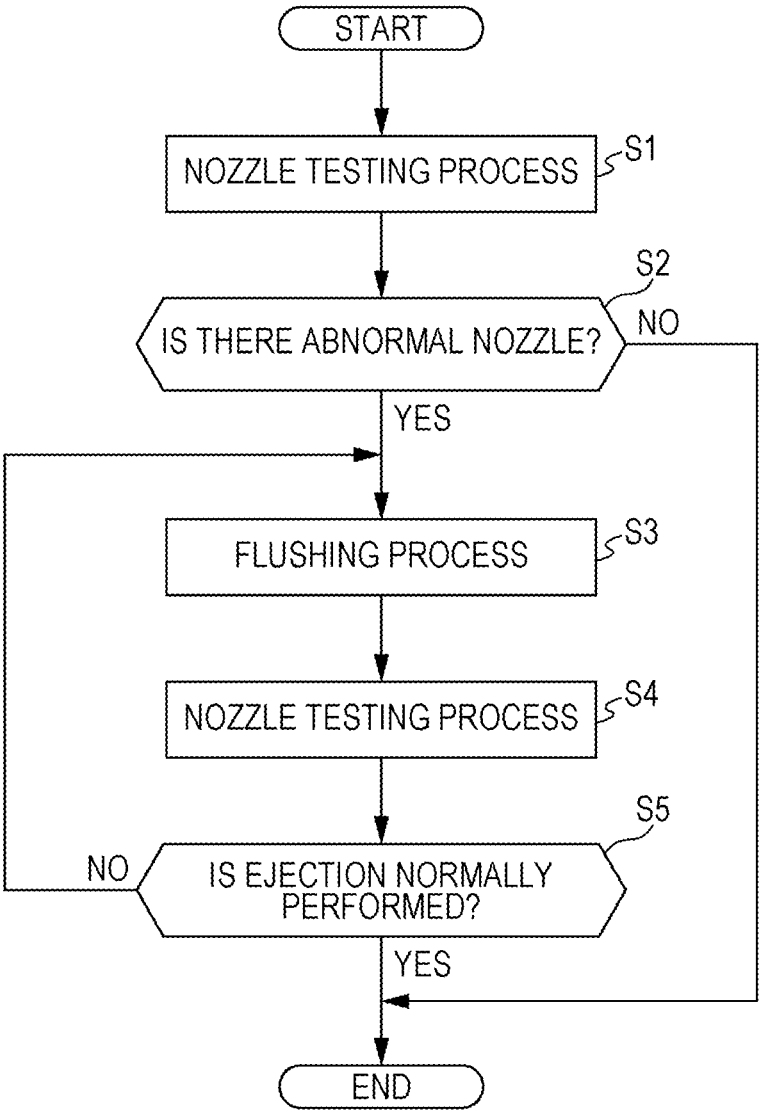
FIG. 4 is a flow chart explaining a control flow of the printer.
Figure 5A:
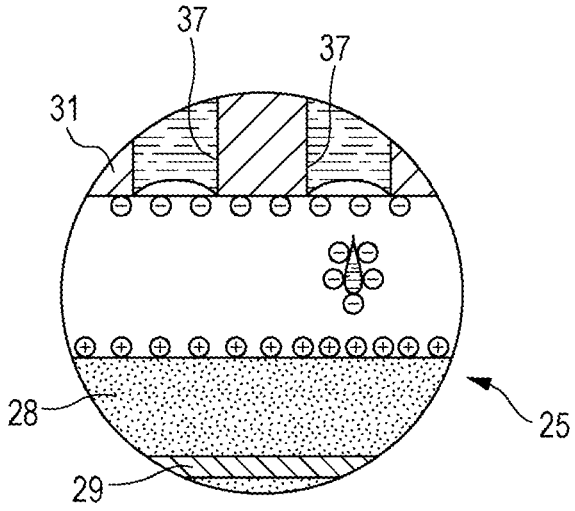
FIG. 5A and FIG. 5B are schematic views explaining a principle of testing an ejecting state of the nozzle using a nozzle abnormality detecting mechanism.
Figure 5B:
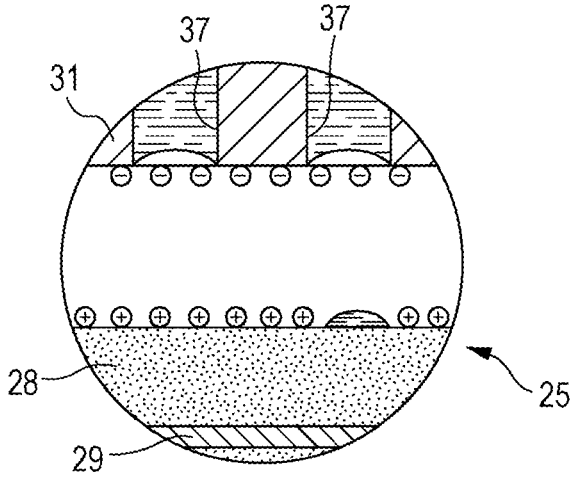

FIG. 4 is a flow chart explaining a control flow of the printer 1 and FIG. 5A and FIG. 5B are schematic views explaining a principle of testing an ejecting state of the nozzle 37 using a nozzle abnormality detecting mechanism 14. As described above, at each constant interval during the recording process or after the wiping process, the recording head 6 is moved up to the upper portion of the capping mechanism 20 in the home position to perform the nozzle testing process (step S1). The nozzle abnormality detecting mechanism 14 detects a flying speed or a weight of the ink when the ink is ejected from the nozzle 37 of the recording head 6 to the cap 25 as a liquid receiving unit which is disposed in the capping mechanism 20 of the home position. The inner portion of the cap 25 in the capping mechanism 20 is provided with a conductive ink absorbing material 28 and a mesh-like electrode member 29. Further, an electric field is provided such that, for example, the electrode member 29 is set to a positive pole, and the nozzle plate 31 of the recording head 6 is set to a negative pole. Herein, since the electrode member 29 is contacted with the conductive ink absorbing material 28, the surface of the ink absorbing material 28 also has the same electric potential as that of the electrode member 29. Further, nozzle abnormality detecting mechanism 14 detects voltage variation until the ink is ejected from the nozzle 37 to be landed on the surface of the ink absorbing material 28 in the cap 25, and outputs the detected result as a detection signal to a control unit 9 of the printer controller 7.

The control unit 9 moves the carriage 16 up to the capping mechanism 20 of the home position to cause the nozzle surface of the recording head 6 to face the cap 25. In this state, the control unit 9 causes each nozzle 37 to perform the ejecting operation to execute the nozzle testing process using the nozzle abnormality detecting mechanism 14. In the case of occurrence of the ejection abnormality, for example, when a flying direction of the ink ejected from the nozzle 37 is remarkably bent to be deviated from the original target direction, when an amount (weight and volume) of the ejected ink is remarkably deviated from the target value, when the ink is not ejected from the nozzle 37, a value of the detection signal from the nozzle abnormality detecting mechanism 14 is changed to be deviated from the normal valve. One of the causes of such an ejection abnormality may include, for example, air bubbles which are mixed into the liquid in the nozzle 37. When the value of the detection signal is changed to be deviated from the value of the normal state, the control unit 9 determines that the ejection abnormality occurs in the nozzle 37. After the nozzle testing process, the control unit 9 determines whether or not there is any nozzle 37 having the ejection abnormality based on the test result (step S2). When there is no nozzle 37 having the ejection abnormality, in other words, when it is determined that all of the nozzles 37 can normally eject the ink (No), the process ends without the further procedures after step S3. On the other hand, when it is determined that there is the nozzle 37 having the ejection abnormality in step S2 (Yes), the control unit 9 controls the carriage moving mechanism 4 to move the carriage 16 up to the upper portion of the flushing box 23, and causes the nozzle surface of the recording head 6 to face the ink receiving unit 27 (See FIG. 1). In this state, the control unit 9 performs the flushing process on the nozzle 37 which hardly ejects the ink in the normal state (step S3).

The flushing process according to the embodiment corresponds to a maintenance process of which a purpose is to mainly perform an operation of ejecting the ink from the nozzle 37 and thus to discharge the air bubbles remaining in the inner portion (in the vicinity of a meniscus) of the nozzle 37. This maintenance process is different from a flushing process which is performed in order to discharge a thickened ink or the air bubble in the nozzle 37 or the pressure chamber 38 before the recording process with a power source of the printer 1 turned on. Herein, the ejecting operation in the flushing process means an operation in which a flushing pulse Pf (to be described later) causes the piezoelectric element 33 to be driven and thus the pressure variation in the pressure chamber 38 occurs regardless of whether or not the ink is actually ejected from the nozzle 37.

Figure 6:
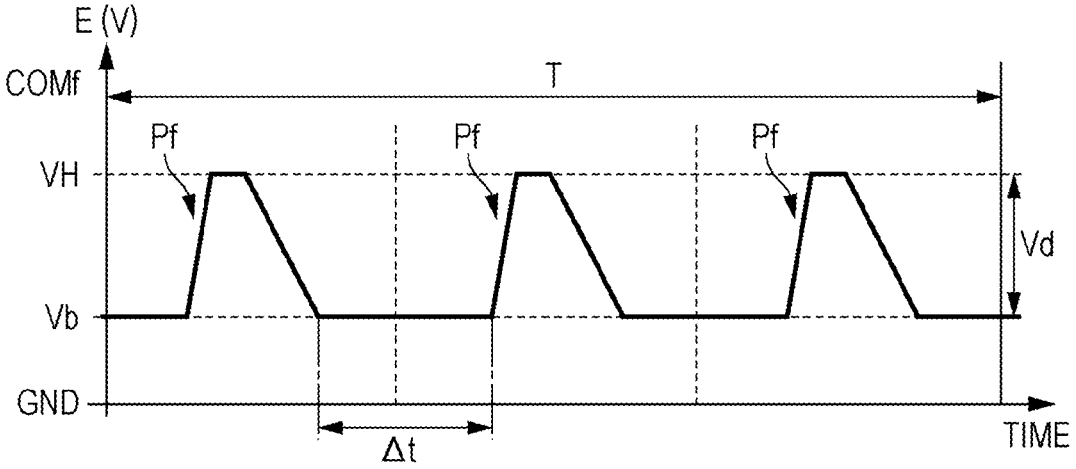
FIG. 6 is a waveform diagram explaining a configuration of a drive signal used for a flushing process.
Figure 7:
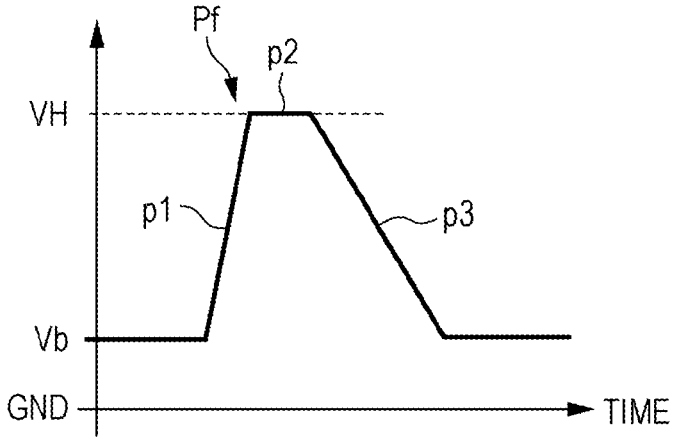
FIG. 7 is a waveform diagram explaining a configuration of a flushing pulse.

FIG. 6 is a waveform diagram explaining an example of a flushing drive signal used for a flushing process in step S3. FIG. 7 is a waveform diagram explaining a configuration of a flushing pulse Pf. The flushing drive signal COMf according to the embodiment generates a total of three flushing pulses Pf to be formed at a regular interval. The flushing pulse Pf is a kind of maintenance drive waveform which causes a meniscus in the nozzle 37 not to be positively attracted from the initial position (the piezoelectric element 33) to the pressure chamber 38, but causes the meniscus to be extruded to the ejection side and thereby causes the ink to be ejected. More specifically, the flushing pulse Pf according to the embodiment includes a contracting element p1, a contract maintaining element p2, and an expanding element p3. The contracting element p1 is a waveform element of which electric potential changes to a plus side in the form of a steep gradient from a reference electric potential Vb to a contract electric potential VH. Herein, a state in which the reference electric potential Vb is applied to the piezoelectric element 33 corresponds to an initial state (a reference state), and a position of the meniscus inside the nozzle 37 in this initial state corresponds to the initial position according to one aspect of the invention. The meniscus in the initial position is located toward the vicinity (somewhat nearer to the pressure chamber 38) of the opening on the ejection side (opposite to the pressure chamber 38) in the nozzle 37. The electric potential difference Vd from the reference electric potential Vb to the contract electric potential VH and the gradient of the electric potential variation of the contracting element p1 are set so as to eject the maximum amount of the ink which the recording head 6 of the above configuration is able to eject from the nozzle 37. The contract maintaining element p2 is a waveform element which maintains the contract electric potential VH for a predetermined time. Further, the expanding element p3 is a waveform element of which electric potential changes in the form of a sufficiently gentle gradient from the contract electric potential VH to the reference electric potential Vb. Further, the fact that the meniscus is not positively attracted into the pressure chamber side means that basically there is no waveform element which causes the pressure chamber 38 to be expanded and thus causes the meniscus to be attracted into the pressure chamber, before the contracting element p1 in the flushing pulse Pf. However, even though there are such other waveform elements before the contracting element p1, and if almost all of the air bubbles are returned to the original state (a state before the pressure chamber is expanded by the waveform element having a function of expanding the waveform element) at the time point when the contracting element p1 is applied to the piezoelectric element 33, there may be other such waveform elements before contracting element p1.

Figure 9A:
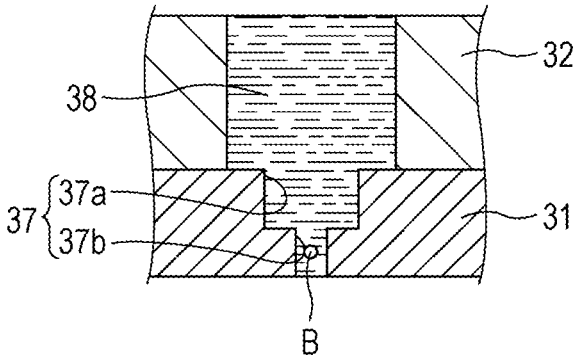
FIG. 9A, FIG. 9B and FIG. 9C are schematic views explaining a state of ejecting ink from a nozzle in the flushing process.
Figure 9B:
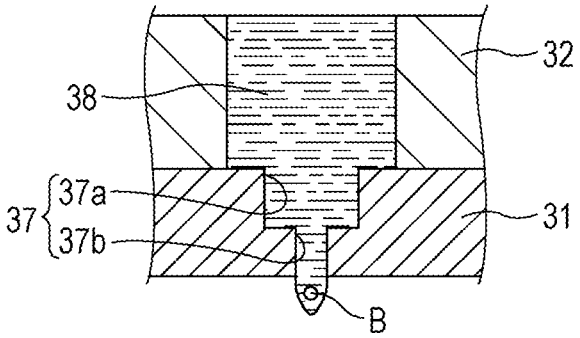
Figure 9C:
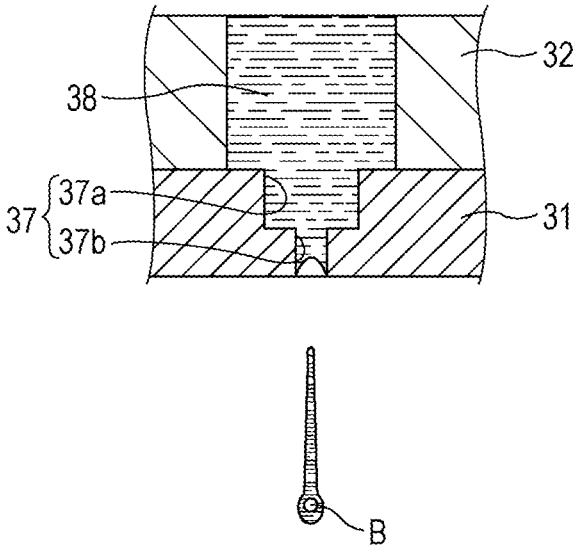

FIG. 9A, FIG. 9B, and FIG. 9C are schematic views (sectional views of the nozzle 37) explaining a state of ejecting ink from the nozzle 37 in the flushing process. FIG. 9A shows the initial state described above. In this state, the air bubbles B stay in the ink inside the second nozzle unit 37*b* in the nozzle 37. The nozzle 37 is an ejection abnormality nozzle in which the ejection abnormality occurs due to the air bubbles B. When the flushing pulse Pf having such a configuration is applied to the piezoelectric element 33 corresponding to the nozzle 37, the contracting element p1 causes the piezoelectric element 33 to be bent to the inner side of the pressure chamber 38 (a side close to the nozzle plate 31). Accordingly, the pressure chamber 38 is drastically contracted from a reference volume which corresponds to the reference electric potential Vb to a contract volume which corresponds to a contract electric potential VH. Therefore, the ink in the pressure chamber 38 is compressed and thus the meniscus located at the initial position is drastically extruded to the ejection side along the central axial direction of the nozzle to be extended like a liquid column (FIG. 9B). At this time, the air bubbles B in the vicinity of the meniscus follow the ink in the nozzle to be extruded to the ejection side. At this time, the air bubbles B are contracted according to the inner rising pressure in the pressure chamber 38.

The contract state of the pressure chamber 38 is maintained during a constant time due to the contract maintaining element p2. During this time, the rear end portion of the liquid column extruded to the ejection side is separated from the meniscus, and flies toward the ink receiving unit 27 of the flushing box 23 in a state where the rear end portion contains the air bubbles B therein (see FIG. 9C). After the contract maintaining element p2, subsequently the expanding element p3 is applied such that the piezoelectric element 33 is contracted up to a state corresponding to the reference electric potential Vb. With this, the pressure chamber 38 is gently expanded and returned from the contract volume to the reference volume corresponding to the reference electric potential Vb, and thereby the meniscus is gradually returned up to the initial position. A weight per one droplet in the ink which is ejected from the nozzle 37 due to the flushing pulse Pf is approximately 10 [ng]. In contrast to this, when images and the like are recorded on the recording media, a weight per one droplet in the ink which is ejected from the nozzle 37 is approximately 7 [ng]. Since the electric potential variation of the expanding element p3 goes along slowly in the flushing pulse Pf, compared with the contracting element p1, the expanding element p3 causes the piezoelectric element 33 to be driven and the pressure variation generated in the pressure chamber 38 to be relatively slowly changed. For this reason, the residual vibration after the ejection operation can be also suppressed to become relatively small.

In the embodiment, for a one-time flushing process, the flushing pulse Pf is applied to the piezoelectric element 33 corresponding to one nozzle 37, three times in a regular interval to perform the ejecting operation. In the nozzle 37 in which the ejection abnormality occurs due to the air bubbles B, there is a possibility that the ink is not ejected during the first ejection operation. However, the ejecting operation based on the flushing pulse Pf is performed three times and thereby the ink is ejected from the nozzle 37 to be able to discharge the air bubbles. In this case, the interval for applying the pulse Pf is set to a time period to the extent that the residual vibration which is generated in the ink inside the pressure chamber 38 and the nozzle 37 due to the previous ejecting operation almost settles down by the timing when the next operation is performed. Therefore, the discharge performance of the air bubbles B in the vicinity of the meniscus becomes upgraded in the flushing process. In other words, when the next ejecting operation is performed in a state where the residual vibration generated in the previous ejecting operation does not yet settle down, there may be an excitation of the residual vibration. Further, the more the residual vibration increases, the more the degree of the expansion and contraction of the air bubbles B in the nozzle 37 increases accordingly. If the air bubbles B are expanded, the expanded air bubbles B move to the pressure chamber due to the buoyancy thereof. Therefore, there is a problem that the discharge performance of the air bubbles becomes degraded in the flushing process. For example, if the air bubbles B are located in a range of 35 [μm] from the meniscus to the pressure chamber in the axial direction of the nozzle 37, the flushing process based on the flushing pulse Pf can cause the air bubbles B to be discharged. Accordingly, if the air bubbles B go away beyond the range of 35 [μm] from the meniscus in the central axial direction of the nozzle 37, it is difficult to discharge the air bubbles B even through the flushing process is performed.

Herein, the buoyancy that acts on the air bubbles B in the nozzle is expressed according to the Archimedes' principle as a following expression (1) where a diameter of the air bubble B is r, a density of the ink is ρ, and gravitational acceleration is g.

$$F=4\pi r^3\rho g/3 \quad (1)$$

Next, a resistance force that acts on the air bubbles B is expressed as a following expression (2) where a viscosity of the ink is η, and a speed of the air bubble B (a speed (a speed in the endless liquid) when ignoring a flow path resistance occurring due to the inner wall in the nozzle) is U.

$$F=6\pi\eta rV \quad (2)$$

Based on the expressions (1) and (2), a buoyancy speed U of the air bubble B in the ink is expressed as a following expression (3).

$$U=4.5r^2\rho g/\eta \quad (3)$$

In other words, in light of the expression (3), it is understood that the bigger the air bubble B becomes, the faster the buoyancy speed of the air bubble becomes.

Further, a buoyancy speed u of the air bubble B in the nozzle 37 is expressed as the following expression (4) proposed by Clift or the following expression (5) proposed by Wallis where an inner diameter of the nozzle 37 is d, and λ=r/d.

$$u/U=(1-\lambda^{/2})^{3/2} \text{ for } \lambda<0.6 \quad (4)$$

$$u/U=(1.13\exp(-\lambda) \text{ for } <0.6 \quad (5)$$

For example, if d=20 [μm] and r=10 [μm] are assumed, λ=0.5 is established, and the buoyancy speed u of the air bubble in the second nozzle unit 37*b* becomes u=0.650×U=9.42 [μm/s] according to the expression (4), and u=0.685×U=9.94 [μm/s] according to the expression (5).

Accordingly, in the flushing process, it is preferable not to expand the air bubbles B if possible. For this reason, it is preferable to avoid the inner pressure variation in the pressure chamber 38, especially the drastic decompression and to suppress the residual vibration which is a cause of changing the size of the air bubble B, if possible.

The flushing pulse Pf causes the meniscus in the nozzle 37 not to be substantially changed from the initial position (the piezoelectric element 33) to the pressure chamber 38, and thereby causes the ink to be discharged. In the embodiment, this flushing pulse Pf is used as a drive waveform for the ejecting operation in the flushing process so as to avoid the drastic decompression inside the pressure chamber and thus suppress the floating of the air bubbles which would be otherwise caused by the drastic expansion of the air bubbles in the flushing process. Further, a time Δt from an ending terminal of the previous flushing pulse Pf (an ending portion of the expanding element p3) to a starting terminal of a next flushing pulse Pf (a staring terminal of the contracting element p1) is set to be more than or equal to the Helmholtz vibration cycle (natural vibration frequency cycle) Tc related to a vibration (pressure wave) occurring in the ink inside the pressure chamber 38. Therefore, since a next ejecting operation is performed in a state where almost all of the residual vibration generated due to the previous ejecting operation settle down, the unnecessary expansion and contraction of the air bubbles B is suppressed. For this reason, it is possible to restrain the air bubbles B from moving to the pressure chamber 38 due to the buoyancy thereof and improve the discharge performance of the air bubbles. Further, the ejecting operation is performed three times at the above interval in the one-time flushing process, and thus almost all of the air bubbles in the nozzle 37 can be discharged. For example, even though the air bubbles are attached to the inner wall of the nozzle 37 and the ink is not ejected from the nozzle 37 during the first-time ejecting operation, the ink is extruded to the ejection side through the first-time ejecting operation and thus the moving of the ink causes the air bubbles to be easily separated and moved from the inner wall of the nozzle. Accordingly, it is possible to discharge the air bubbles B with the ink from the nozzle 37 through the second-time and the third-time ejecting operations. In order to discharge the air bubbles in the ink inside the nozzle 37 more effectively, it is preferable that three times of the ejecting operations are performed with the flushing pulse Pf according to the embodiment. However, if it is possible to discharge the air bubbles B in the nozzle 37, for example, it may be possible to use a configuration that performs at least the first-time ejecting operation with the flushing pulse Pf among the three times of the ejecting operations, and performs the remained ejecting operations with other drive pulses, specifically, with general flushing pulses Pf to be described later or a drive pulse used for the typical recording operation, and the like. Further, the flushing operation is not limited to the three times of the ejecting operations, but may be applied to four or more times of the ejecting operations. In this case, the drive pulses of the fourth or greater time may be the flushing pulse or other drive pulses.

Herein, the Tc is uniquely selected for each recording based on shapes, sizes, rigidities, and the like of each constitutional member such as the nozzle 37, the pressure chamber 38, the ink supplying port 43, the piezoelectric element 33, and the like. The natural vibration frequency cycle Tc may be expressed as, for example, the following expression (6).

$$Tc=2\pi\sqrt{[[(Mn\times Ms)]\times Cc]} \quad (6)$$

In the expression (6), Mn is an inertance in the nozzle 37, Ms is an inertance in the ink supplying port 43, and Cc is a compliance in the pressure chamber 38 (indicating degrees of volume variation and flexibility per unit pressure). Further, in the expression (6), the inertance M indicates a degree of easy mobility of liquid in the flow path. In other words, the inertance M indicates mass of liquid per unit sectional area. Further, when a fluid density is ρ, a sectional area of a plane orthogonal to a flowing-down direction of the fluid in the flow path is S, and the length of the flow path is L, the inertance M can be approximately expressed as a following expression (7).

$$M=(\rho\times L)/S \quad (7)$$

Further, the Tc is not limited to the above expression (6), but may be also a vibration cycle that the pressure chamber 38 of the recording head 6 has.

As described above, after the flushing process is performed, subsequently, the nozzle abnormality detecting mechanism 14 performs the nozzle testing process again in step S4. Further, after the nozzle testing process, the control unit 9 determines whether or not the ink is normally ejected from the nozzle 37 (whether or not the ink is ejected to meet a desired amount and a flying speed which are defined in the specification) based on the detection result (step S5). Herein, when it is determined that there is no nozzle 37 having the ejection abnormality, in other words, that all of the nozzles 37 can eject the ink normally (Yes), the process ends. On the other hand, in step S5, when it is determined that the ink is not normally ejected (No), the process returns to step S3, and the following process is performed. Further, when it is determined that the ink is not normally ejected, the flushing process is not performed again in step S3, but a general maintenance process for the printer may be performed instead. The general maintenance process may include, for example, a so called cleaning process in which the ink is attracted from the nozzle 37 in a state where the nozzle surface is capped by the capping mechanism 20.

Herein, a flushing process pulse Pf which is used in a general flushing process of the related art will be described for comparison.

Figure 8:
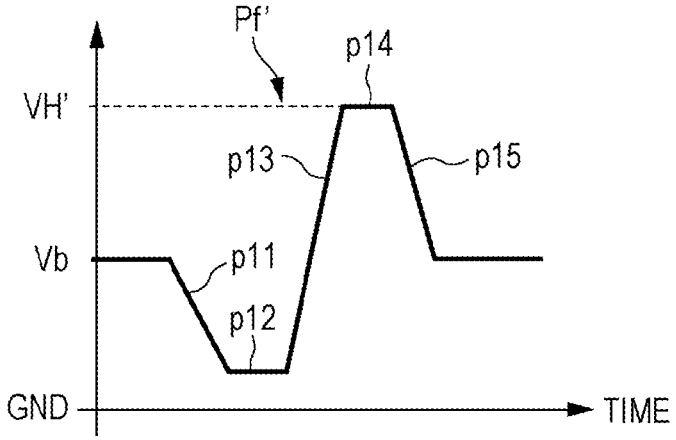
FIG. 8 is a waveform diagram explaining a configuration of flushing pulse of a related art.
Figure 10A:
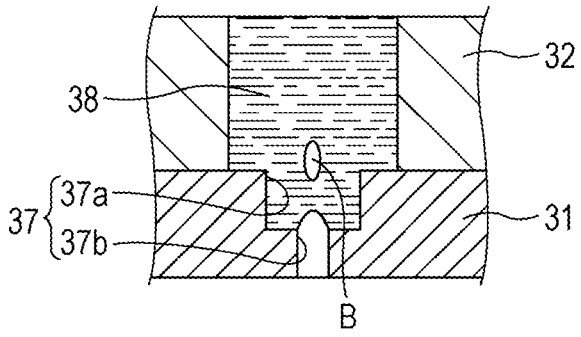
FIG. 10A, FIG. 10B and FIG. 10C are schematic views explaining a state of ejecting ink from a nozzle in the flushing process of the related art.
Figure 10B:
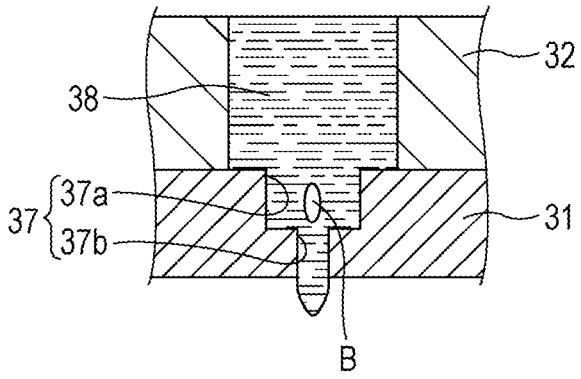
Figure 10C:
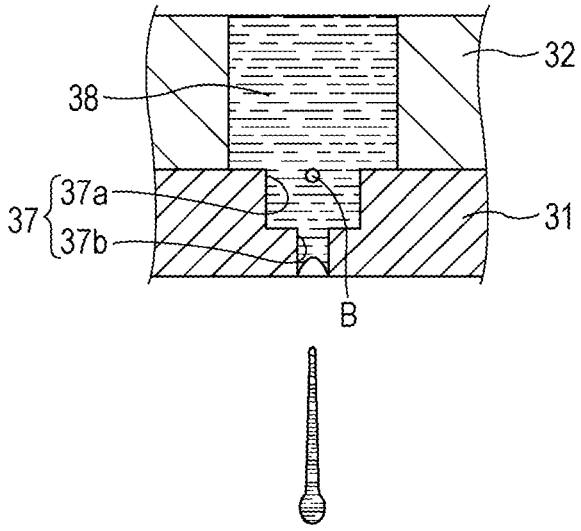

FIG. 8 is a waveform diagram explaining a configuration of flushing pulse Pf. Further, FIG. 10A, FIG. 10B, and FIG. 10C are schematic views explaining a state of ejecting the ink from a nozzle 37 using the flushing pulse Pf. The flushing pulse Pf includes a pre-expanding element p11, an expansion maintaining element p12, a contracting element p13, a contraction maintaining element p14, and an expanding element p15. In other words, the flushing pulse Pf firstly expands the pressure chamber 38 with the pre-expanding element p11 before causing the ink to be ejected from the nozzle 37 so as to strongly attract the meniscus into the pressure chamber (see FIG. 10A). Accordingly, the air bubbles B in the vicinity of the meniscus is also moved to the pressure chamber. At this time, the internal pressure in the pressure chamber 38 decreases to cause the air bubbles B to be expanded accordingly. Therefore, the air bubbles B floats as described above and are separated from the meniscus to the pressure chamber 38. For this reason, even though the contracting element p13 causes the pressure chamber 38 to be contracted after that, and causes the meniscus to be drastically extruded to the ejection side, the air bubbles B do not follow the meniscus (see FIG. 10B). As a result, even when the ink is ejected from the nozzle 37, the air bubbles B are not discharged to remain intact in the nozzle 37 (see FIG. 10C).

In contrast to this, the flushing pulse Pf according to one aspect of the invention does not substantially displace the meniscus from the initial position to the pressure chamber side. In other words, stirring of the ink is suppressed and the ink is extruded from the initial position and ejected from the nozzle 37. Therefore, the air bubbles B in the vicinity of the meniscus are restrained from being unnecessarily expanded, and thereby the air bubbles B is restrained from floating to the pressure chamber. As a result, the air bubbles B can be efficiently discharged with a relatively small amount of ejection.

Further, in the ejecting operation related to a drive waveform which causes an amount of the ejected ink for one-time ejecting operation to be relatively small, for example, a drive pulse for small dot which causes the smallest liquid droplet to be ejected in the printer 1, there is provided a configuration in which the meniscus is repeatedly attracted in or pushed in to eject small droplets. Therefore, the vibration of the ink is likely to be complicated, and also the air bubbles in the nozzle repeatedly expand and contract accordingly. Therefore, the air bubbles are eventually separated from the meniscus, which causes a problem that the discharge performance of the air bubbles is degraded. In contrast to this, since one aspect of the embodiment uses the flushing pulse Pf as a drive waveform which causes the largest amount of liquid that can be ejected in the printer 1 to be ejected, in the flushing process, a relatively greater amount of the ink for one time can be ejected from the nozzle 37. Further, since the pressure variation in the pressure chamber 38 goes along slowly changed during the ejecting operation, compared with the drive waveform which causes the above small ink droplet to be ejected, the unnecessary vibration is hardly generated in the pressure chamber 38 and it is possible to more efficiently discharge the air bubbles with the ink in the nozzle.

As described above, in the printer 1 according to one aspect of the invention, it is possible to suppress the unnecessary consumption of the ink and to discharge the air bubbles in the nozzle 37 with the ink. Specifically, in the nozzle testing process, the nozzle 37 which hardly eject the ink in the normal manner is subjected to the flushing process using the flushing pulse Pf for at least the first time, and thus an unnecessary flushing process is not performed. Further, since only one to three times of the ejecting operation are performed to discharge the air bubbles in the nozzle during one-time flushing operation, the consumption of the ink can be largely reduced, compared with the maintenance process of such as a flushing process or an attraction-based cleaning process of the related art and the like.

Further, the above embodiments exemplify the piezoelectric element 33 of a so called bending vibration type as an actuator, but is not limited thereto. For example, one aspect of the above embodiment may use a piezoelectric element of so called vertical vibration. In this case, the waveform corresponds to a waveform of which electric potential variation direction, that is, an up to down direction, is inverted with respect to the flushing pulse Pf exemplified in one aspect of the above embodiment.

Further, the actuator is not limited to the piezoelectric element. One aspect of the invention may be also applied to the cases that various types of actuators such as an electrostatic actuator that uses the electrostatic force to change the volume of the pressure chamber.

Further, the above embodiments exemplify the nozzle abnormality detecting mechanism 14 which is configured to charge the ink droplet with electricity, to detect the charged ink and thus to detect the abnormality of the nozzle 37, but is not limited thereto. For example, a configuration may be used in which a test pattern and the like are printed on the recording media, the pattern is tested with an optical sensor, and the abnormality or non-abnormality of the ejection is detected. Further, based on a counter-electromotive power generated in the piezoelectric element due to the residual vibration after ejecting of the ink droplet, the abnormality or non-abnormality of the ejection may be also detected.

Besides, a configuration may be used in which an irradiation unit that emits a laser and a detecting unit that detects the laser are provided to detect whether or not the flying ink droplet screens the laser or to detect a weight of the ejected ink droplet, and thus to detect the abnormality or the non-abnormality of the ejection.

Further, one aspect of the invention is not limited to the printer as long as a liquid ejecting apparatus performs the flushing process which causes the air bubbles in the nozzle to be discharged. One aspect of the invention may be also applied to the various types of ink jet type recording apparatuses such as a plotter, a facsimile apparatus, and a copying machine, or a printing apparatus that lands the ink from the liquid ejecting head and performs the printing on a fabric (material to be printed) which is a kind of a target to be landed on, or a liquid ejecting apparatus other than the recording apparatuses such as, for example, a display manufacturing apparatus, an electrode manufacturing apparatus, or a chip manufacturing apparatus.

What is claimed is:

1. A liquid ejecting apparatus, comprising:

a liquid ejecting head that includes pressure chambers communicating with nozzles, and actuators causing a pressure variation of liquid in the pressure chamber to occur, the liquid ejecting head being able to eject the liquid from the nozzle through an action of the actuator; and a detecting mechanism that detects an abnormality of the nozzle in liquid ejection, wherein the liquid ejecting apparatus drives the actuator with a drive waveform to perform a maintenance process, wherein in the maintenance process of causing the drive waveform to be applied plural times to the actuator corresponding to the nozzle that the detecting mechanism detects as being abnormal, and thereby causing the ejecting operation to be performed, at least a first-time drive waveform applied to the actuator is a maintenance drive waveform which causes a meniscus in the nozzle not to be positively attracted from an initial position to the pressure chamber, but causes the meniscus to be extruded to the ejection side and thereby causes the liquid to be ejected from the nozzle, and wherein a flushing pulse which causes a meniscus in the nozzle to be positively attracted from an initial position to the pressure chamber is to be applied to the actuator after the maintenance drive waveform.

2. The liquid ejecting apparatus according to claim 1, wherein in the maintenance process, among the drive waveforms which are applied three or more times, at least the first-time to the third-time drive waveforms are the maintenance drive waveform.

3. The liquid ejecting apparatus according to claim 1, wherein the maintenance drive waveform is a drive waveform that causes the largest liquid amount which the liquid ejecting head can eject to be ejected.

4. A control method of a liquid ejecting head that includes pressure chambers communicating with nozzles, and actuators causing a pressure variation of liquid in the pressure chamber to occur, wherein the liquid ejecting head drives the actuator with a drive waveform to able to eject the liquid from the nozzle, the control method comprising:

in a maintenance process of causing the drive waveform to be applied plural times to the actuator corresponding to the nozzle that is detected as being abnormal in liquid ejection, and thereby causing the ejecting operation to be performed, applying a maintenance drive waveform to the actuator in at least a first time, the maintenance drive waveform causing a meniscus in the nozzle not to be positively attracted from an initial position to the pressure chamber, but causing the meniscus to be extruded to the ejection side, and thereby causing the liquid to be ejected from the nozzle; and applying a flushing pulse which causes a meniscus in the nozzle to be positively attracted from an initial position to the pressure chamber to the actuator after the maintenance drive waveform is applied.

5. A control method of a liquid ejecting apparatus including a liquid ejecting head that includes pressure chambers communicating with nozzles, and actuators causing a pressure variation of liquid in the pressure chamber to occur, the liquid ejecting head being able to eject the liquid from the nozzle through an action of the actuator; and a detecting mechanism that detects an abnormality of the nozzle in liquid ejection, wherein the liquid ejecting apparatus drives the actuator with a drive waveform to perform a maintenance process, the control method comprising:

in the maintenance process of causing the drive waveform to be applied plural times to the actuator corresponding to the nozzle that is detected as being abnormal in liquid ejection, and thereby causing the ejecting operation to be performed, applying a maintenance drive waveform to the actuator in at least a first time, the maintenance drive waveform causing a meniscus in the nozzle not to be positively attracted from an initial position to the pressure chamber, but causing the meniscus to be extruded to the ejection side, and thereby causing the liquid to be ejected from the nozzle; and applying a flushing pulse which causes a meniscus in the nozzle to be positively attracted from an initial position to the pressure chamber to the actuator after the maintenance drive waveform is applied.

* * * * *